US006023817A

United States Patent [19]

Clewans

[11] Patent Number: 6,023,817

[45] Date of Patent: Feb. 15, 2000

[54] CUFF LINK HAVING INTERCHANGEABLE OUTER ELEMENT

[76] Inventor: Bonnie G. Clewans, 3963 Main St., Amherst, N.Y. 14226

[21] Appl. No.: 09/268,581

[22] Filed: Mar. 15, 1999

[51] Int. Cl.[7] ..... A44B 1/00; A44B 5/00

[52] U.S. Cl. ..... 24/102 SL; 24/41.1; 24/90.5; 24/102 FC; 24/114.11

[58] Field of Search ..... 24/102 SL, 102 FC, 24/90.5, 41.1, 43, 114.9, 114.11

[56] References Cited

U.S. PATENT DOCUMENTS

| | | | |
|---|---|---|---|
| 0,534,472 | 2/1895 | Goldner | 24/102 SL |
| 0,781,171 | 1/1905 | Adler | 24/102 SL |
| 1,219,873 | 3/1917 | Sapo . | |
| 1,228,212 | 5/1917 | Houser | 24/102 SL |
| 1,362,402 | 12/1920 | Ehrenfeld . | |
| 1,369,926 | 3/1921 | Khan . | |
| 1,686,235 | 10/1928 | Heasley . | |
| 2,129,640 | 9/1938 | Augenstein | 24/102 SL |
| 2,262,161 | 11/1941 | Blumstock | 24/102 |
| 2,510,988 | 6/1950 | Lewis | 24/102 |
| 2,637,083 | 5/1953 | Plotnizky | 24/102 |
| 4,691,416 | 9/1987 | Nakayama et al. | 24/102 SL |

FOREIGN PATENT DOCUMENTS

| | | | |
|---|---|---|---|
| 0640461 | 7/1928 | France | 24/102 SL |
| 0754985 | 11/1933 | France | 24/102 SL |
| 0195052 | 8/1907 | Germany | 24/102 SL |
| 0189464 | 2/1937 | Switzerland | 24/102 SL |
| 0001650 | 9/1911 | United Kingdom | 24/102 SL |

*Primary Examiner*—Victor N. Sakran
*Attorney, Agent, or Firm*—Charles E. Temko

[57] ABSTRACT

A cuff link including interconnected outer and inner elements, in which said outer element is in the form of a shank button which is maintained in interchangeable interconnection with said inner element by a manually operable clasp permanently attached to the inner element.

1 Claim, 1 Drawing Sheet

CUFF LINK HAVING INTERCHANGEABLE OUTER ELEMENT

BACKGROUND OF THE INVENTION

This invention relates generally to the field of jewelry, and more particularly to an improved cuff link particularly suitable for use by women wherein the exposed outer button-like element may be readily interchanged to match buttons on a garment being worn.

Conventional cuff links typically feature an outer element which is mounted on a rigid or flexible link at one end thereof, with the other end of the link interconnected to a retaining element in the form of a second button, or laterally extending bar. While it is not uncommon for a user to possess several pairs of cuff links of different appearance, the outer element is seldom stylistically related or coordinated with the buttons on a particular garment.

Many women's garments are provided with highly ornamental shank-type buttons of unique appearance, which would be effectively complemented by cuff links worn on the sleeves of a blouse to present a coordinated appearance.

SUMMARY OF THE INVENTION

Briefly stated, the invention contemplates the provision of an improved cuff link of the class described in which the appearance of the outer button element may be conveniently changed using additional buttons normally supplied with a garment at the time of purchase, so that the cuff link may have an appearance related to the garment, either corresponding to the design of the buttons on the garment, or of the same color as the garment when it is worn over a sleeved blouse. To this end, the disclosed cuff link is provided with a manually operable clasp which engages the shank portion of a desired button, the button being readily replaceable with another shank button, as desired.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
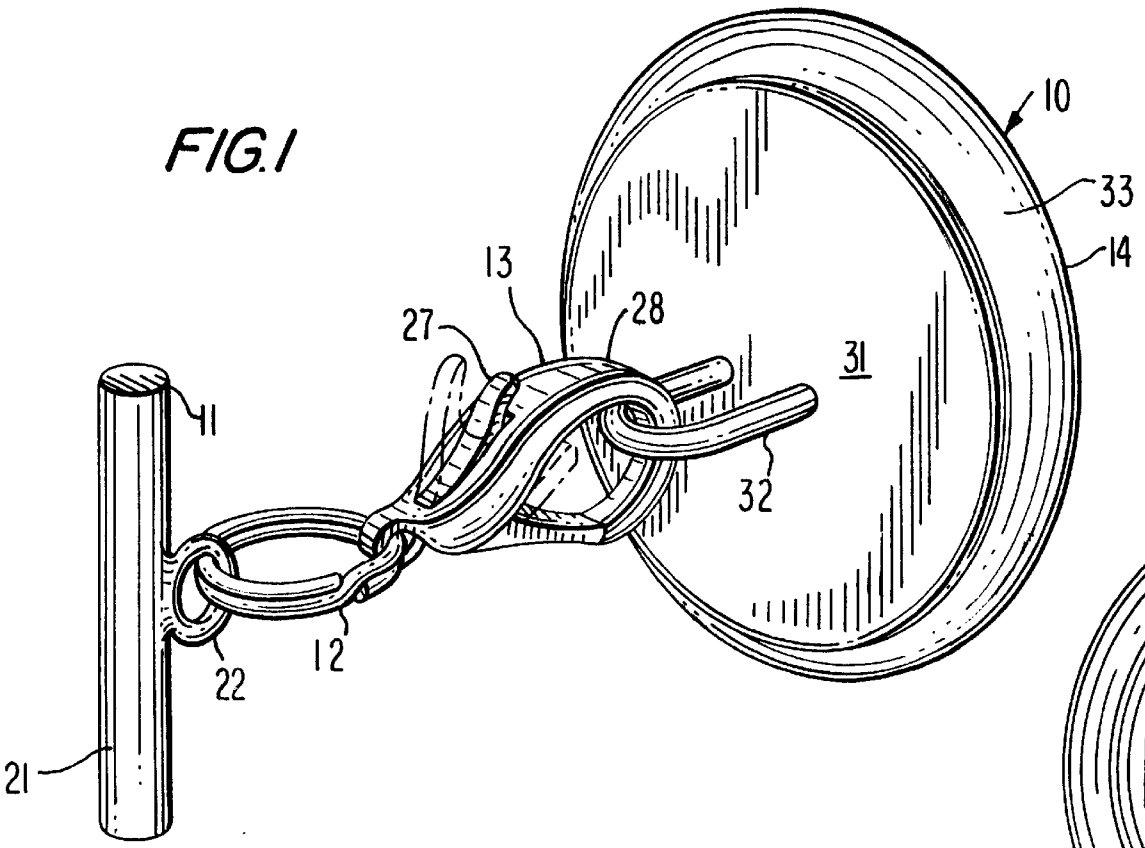
FIG. 1 is an exploded view in perspective of an embodiment of the invention.
Figure 2:
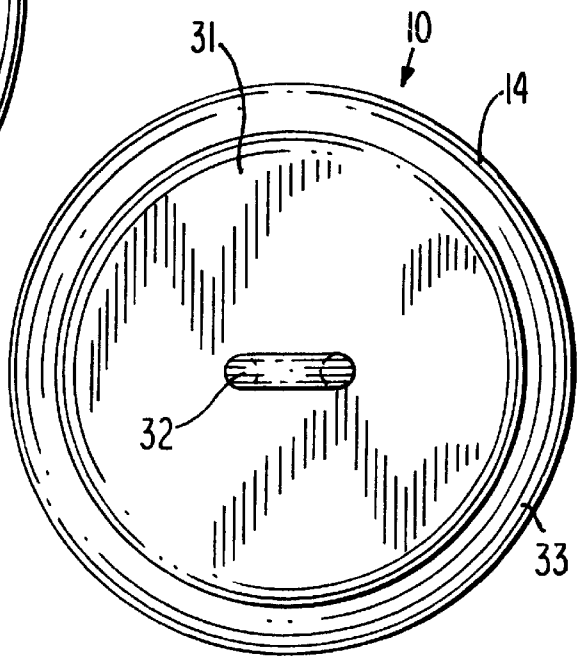
FIG. 2 is an inner end view of a shank button forming a part of the embodiment.

In accordance with the invention, the device, generally indicated by reference character 10, comprises broadly: an inner retaining element 11, a linking loop 12, a manually operable clasp 13, and an outer shank button element 14.

The inner retaining element is preferably in the form a laterally-extending bar 21 having a rigid medially positioned closed loop 22. The loop 12 is preferably in the form of a wire spiral which interconnects the loop 22 to the clasp 13.

In the preferred embodiment, the clasp 13 is preferably of "lobster claw" type, including a pivotally mounted resilient member 27 which cooperates with a claw member 28. The closure 13 may be substituted by other types known in the jewelry finding art, including the circular type widely used for interconnecting parts of a necklace (not shown).

The outer shank button element 14 may be of any type which presents a looped shank extending from the rear surface thereof, and may be of a unitary molding variety, or preferably a composite button including a metal base 31 from which a shank loop 32 extends, and which engages an outer covering 33 having desired matching characteristics, with respect to color and/or design. Typically, the linkage between the inner and outer elements is in the order of less than one inch.

By providing the manually openable clamp 13, it is possible to rapidly disengage an engaged shank button and replace it with a desired alternate shank button. For use with garments which are not originally supplied with extra buttons, it is possible to provide a group of generally similar outer elements in a wide variety of colors, from which a close color match relative to a garment may be selected.

By providing an inner element which remains permanently attached to the clasp 13, the only structure which is selectively replaced is a single outer shank-type button for each of a pair of cuff links. The clasp remains permanently attached to the inner element at all times, and is substantially concealed when the cuff links are worn.

I wish it to be understood that I do not consider the invention to be limited to the precise details of structure shown and described in the specification, for obvious modifications will occur to those skilled in the art to which the invention pertains.

I claim:

1. In a cuff link having a first outer element, a second inner element, and linking means interconnecting said first and second elements, the improvement comprising: said linking means including a manually operable clasp having opened and closed positions, said outer element being in the form of a button having a rearwardly-extending shank selectively engaged with said clasp; said linking means including a link permanently interconnecting said inner element with a part of said clasp and including an annular ring interconnecting a free end of said clasp in a looped projection on said inner element; whereby during use, said inner element may be laterally shiftable relative to said outer element.

* * * * *